United States Patent [19]

Ida

[11] 4,102,533

[45] Jul. 25, 1978

[54] ADJUSTABLE HEAD RACQUET FRAME

[75] Inventor: Noble N. Ida, Boulder, Colo.

[73] Assignee: Ida Engineering, Inc., Littleton, Colo.

[21] Appl. No.: 793,739

[22] Filed: May 5, 1977

[51] Int. Cl.[2] ..... A63B 51/12

[52] U.S. Cl. ..... 273/73 E

[58] Field of Search ..... 273/73 R, 73 C, 73 D, 273/73 E, 73 G, 73 H, 73 J, 96 R

[56] References Cited

U.S. PATENT DOCUMENTS

| | | | |
|---|---|---|---|
| 1,635,943 | 7/1927 | Larned | 273/73 E |
| 1,862,581 | 6/1932 | Robinson | 273/73 EX |
| 3,904,202 | 9/1975 | DeLorean | 273/73 E |

FOREIGN PATENT DOCUMENTS

| | | | |
|---|---|---|---|
| 2,438,807 | 3/1975 | Fed. Rep. of Germany | 273/73 E |
| 209,845 | 1/1924 | United Kingdom | 273/73 J |
| 247,773 | 2/1926 | United Kingdom | 273/73 E |
| 504,903 | 5/1939 | United Kingdom | 273/73 E |

*Primary Examiner*—Richard J. Apley
*Attorney, Agent, or Firm*—Edwin L. Spangler, Jr.

[57] ABSTRACT

This invention relates to an improved racquet frame of the type having a stringable head characterized by a construction wherein said head comprises a loop formed intermediate the ends of an elongate rod of springable material, said end portions being crossed over one another to define the throat and then bent into spaced substantially parallel relation to produce the handle. Means are interposed between the handle-forming limbs within the throat operative upon actuation to vary the spacing therebetween and thus enlarge or reduce the size of the head thereby varying the string tension to suit the wishes of the user. The crossed over section at the juncture between the head and handle have opposed surfaces thereof cut away to produce elongate notches that cooperate with one another to define a string-receiving slot therebetween atop which is placed an apertured member, the apertures of which overlie the slot and maintain the strings in fixed-spaced relation within the crossed over section.

12 Claims, 4 Drawing Figures

ADJUSTABLE HEAD RACQUET FRAME

Quite a number of sports involve the use of racquets of some sort having strung heads. Among the more popular ones are, of course, tennis, racquet ball, badminton and squash racquets. While squash racquets and racquet ball are usually played indoors under controlled temperature conditions where the ambient temperature remains fairly constant, the ball itself heats up and becomes much more lively than when cold. Tennis, of course, is played both indoors and outdoors under varying conditions which affect the play of the balls, probably the most significant of which are ball wear and altitude, the latter affecting the bounce of the internally pressurized balls to a considerable degree. Of the four, probably the least affect by ambient conditions other than wind when played out of doors is badminton.

In tennis, racquet ball and squash racquets, therefore, occasions arise where it would be most helpful to the serious player if he or she could carefully and accurately adjust the string tension of the racquet strings to accommodate variations in conditions that effect the behavior of the ball in play. For instance, on a chilly day out of doors at sea level, new tennis balls will appear to be heavy and dead due to the decrease in internal pressure. Accordingly, it would be desirable if one could tighten the racquet strings and offset to some degree at least the lack of liveliness inherent in new balls under these conditions. Conversely, in the latter stages of a hotly contested squash racquets match, especially one between hard hitters, the ball becomes so hot and live that much of the "finesse" goes out of the game as it becomes virtually impossible to execute the delicate dropshots and the like which are so characteristic of good squash racquets. Instead, the ball flies around the court and "stays up" and remains in play to a point where a so-called "winner" is tough to come by. Here again, while decreasing the string tension in the racquet is, by no means, a complete solution, it would help bring a degree of shot control back into the game under these conditions.

Racquet designs have been known in the past by means of which the player can adjust the tension in the strings; however, none of them to applicant's knowledge has been commerically successful or even accepted to any significant degree. The reasons for this are severalfold, not the least of which is the fact that, for the most part, the prior art designs just did not function as they were supposed to. More often than not, the strings extruding in one direction were tightened or loosened more than those extending in the opposite direction which, in some instances, were not affected at all. Even though, in time, all the strings would eventually assume the same tension, the eventual tension would be different than that which was set in the beginning. More significant, of course, the racquet played erratically while this equalization in tension took place and this, of course, defeats the whole purpose of the tension adjustment feature.

The other main object was to the fact that the adjustment itself was difficult to make. The need for tools of any kind render the unit completely impractical from a user's standpoint as one would expect. Even without tools, any operation which interrupted play for an appreciable period of time became intolerable.

It has now been found in accordance with the teaching of the instant invention that these and other shortcomings of the prior art racquet frames having provision for adjusting the spring tension have, in large measure, been eliminated by the simple, yet unobvious expedient, of crossing over the hand-forming limbs of the frame after forming the loop for the head therebetween and providing adjustment means between said limbs within the throat which function upon actuation to change the size of the head and thus adjust the string tension with a simple turn of a knob or the like. The resultant change in string tension takes place almost instantly and, moreover, it is uniform due to the fact that the loop changes size in all directions simultaneously and to substantially the same degree. No tools are needed, in fact, the adjustment can be made so rapidly that play need not be interrupted at all. Most significant is the fact that the resultant design does not have any serious effect upon the playing characteristics of the racquet which remain much like that of other racquets.

Accordingly, it is, therefore, the principal object of the present invention to provide a novel and improved stringable racquet frame.

A second objective is the provision of a device of the type aforementioned which includes provision for varying the string tension at will.

Another object of the invention herein disclosed and claimed is to provide a racquet that incorporates a string adjustment feature, yet, in so doing its weight, balance and playing characteristics remain substantially unaffected.

Still another object of the within described invention is the provision of a racquet having an adjustable head that can be enlarged or diminished in size and, in so doing, produces a uniform, albeit different, string tension.

An additional object is to provide a stringable racquet frame which permits the head size to be changed without materially affecting the string spacing.

Further objects are to provide an improved racquet frame which is simple, rugged, easy to operate, relatively inexpensive, versatile, strong and even decorative in appearance.

Other objects will be in part apparent and in part pointed out specifically hereinafter in connection with the drawings that follows, and in which.

Figure 1:
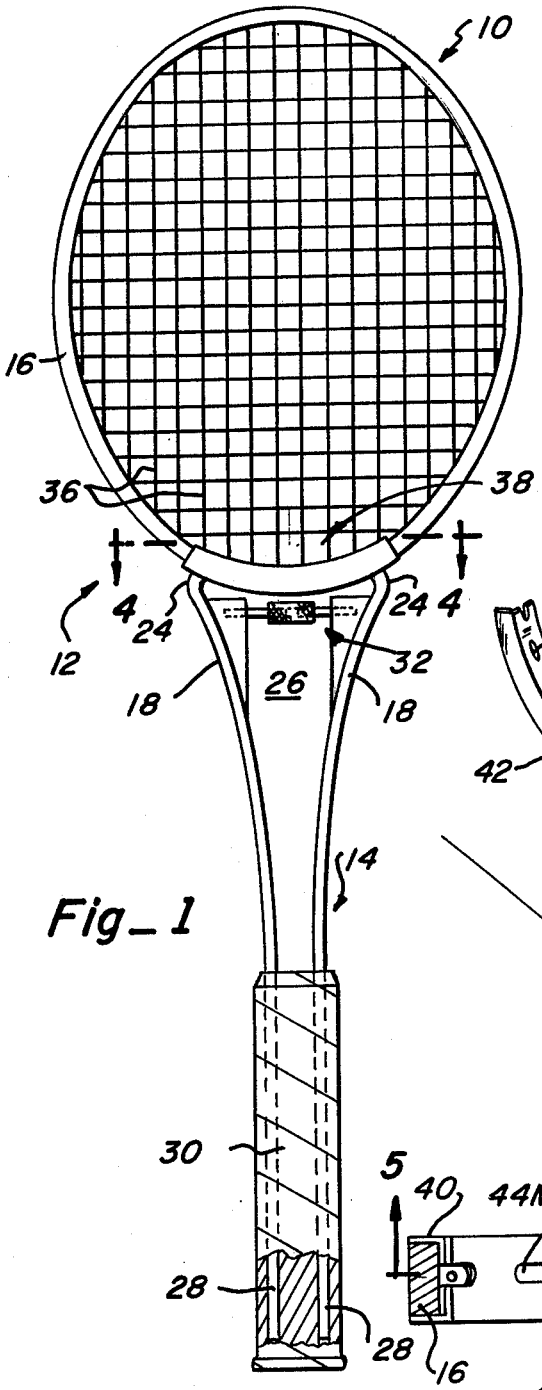
FIG. 1 is a front elevation of the frame.

Referring next to the drawings for a detailed description of the present invention and, initially, to FIG. 1 for this purpose, reference numeral 10 has been selected to designate the frame in its entirety while numerals 12 and 14 have been chosen to similarly denote the head and handle thereof, respectively. Frame 10 is fabricated from an elongate metal or plastic rod or tube which will withstand the stresses of vigorous play while, at the same time, preserving the playing characteristics of more conventional racquets used in the same game. In other words, a steel, aluminum alloy or magnesium alloy could be used to make a tennis, badminton, squash racquets or racquet ball racquet in accordance with the teaching of the instant invention; however, to preserve the weight, feel, weight distribution, flex and other playing characteristics of any of these racquets, the stock out of which they were made would, in all probability, have to be hollow to provide the requisite strength. Conversely, these same racquets fabricated out of plastic, plastic metal laminates and the like would probably be solid due to the considerably lighter nature of the latter materials. Conceivably, even wood, probably in the form of a laminate, could be used; however, as a practical matter the frame would be very difficult to fabricate due to the rather sharp bends required in the throat area. In any event, the selection of a proper material out of which to fabricate the racquet of the instant invention is, first of all, well within the skill of the ordinary artisan and, as such, forms no part of the present invention.

Before proceeding further it would also be well to emphasize that, while the invention has been illustrated and will be described in connection with a tennis racquet frame, the selfsame construction can, without the exericse of inventive skill, be easily adapted to other racquet frames such as those already mentioned provided, of course, they are of the stringable type.

Figure 2:
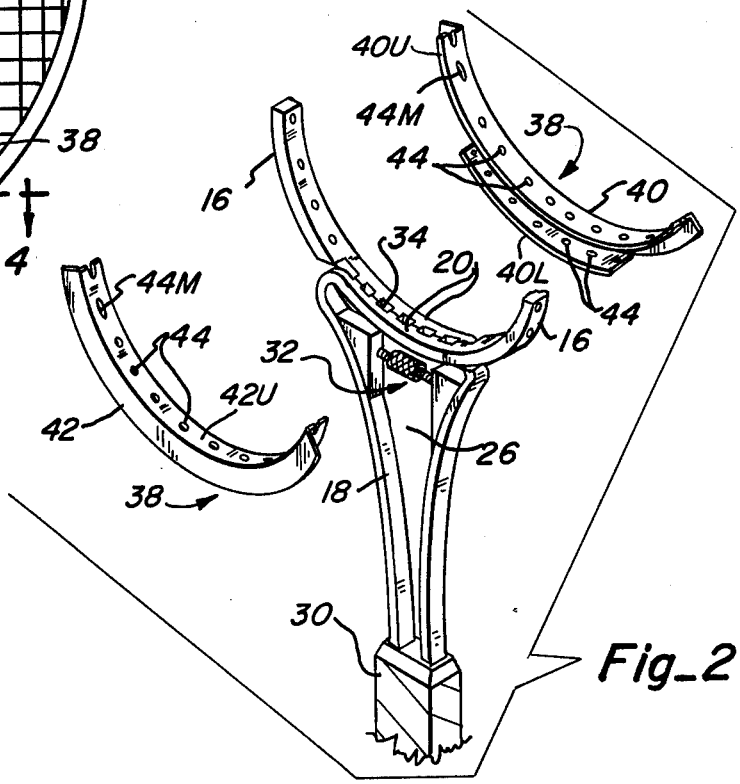
FIG. 2 is a fragmentary exploded perspective view to approximately the same scale as FIG. 1 showing several parts of the racquet in disassembled relation.
Figure 5:
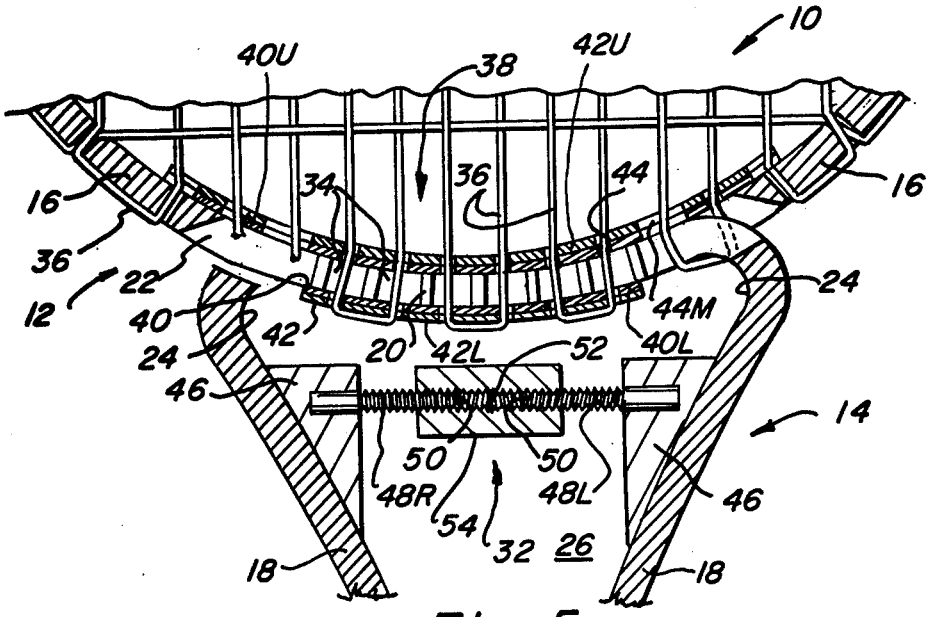
FIG. 5 is a fragmentary section taken along line 5—5 of FIG. 4 to approximately the same scale.

Referring particularly to FIGS. 1, 2 and 5 of the drawings, it will be seen that this elongate rod or tube, whatever material it is made out of, is first bent at a point midway between its ends to define a hoop or loop 16 the shape and size of the racquet head 12. In the case of the tennis racquet illustrated, the head is more or less oval shaped as shown. The opposite limbs 18 of the rod or tube cross over one another at the bottom of the loop and lie in overlapped relation along arcuate section 20 thereof. The opposed overlapped surfaces 22 are recessed in a manner which will be described in greater detail presently in connection with FIGS. 2, 5 and 6 when said surfaces are shown.

At the end of the overlapped arcuate section 20, limbs 18 are each bent through an obtuse angle 24 down and in toward one another so as to define a generally triangularly shaped throat 26 therebetween. Finally, the terminal ends 28 of the limbs 18 are brought into spaced substantially parallel relation to one another and fastened permanently in this relation by handgrip 30 which cooperates therewith to define handle 14. The length of this handle depends, of course, upon the particular type of frame into which the instant invention is being incorporated, that for racquet ball, for example, having a very short handle while those for tennis, squash racquets and badminton being much longer.

Interposed between the limbs 18 within the throat 26 is the tension adjustment means which has been broadly identified by reference numeral 32 and which will be described in detail in connection with FIGS. 1, 2 and 5–8, inclusive. When actuated, of course, this adjustment means either spreads the limbs 18 apart or draws them closer together in the throat area which, in turn, changes the degree of overlap in arcuate section 20 thus contracting or enlarging the size of loop 16 with the net effect that the tension in the strings strung on the latter is changed.

Figure 3:
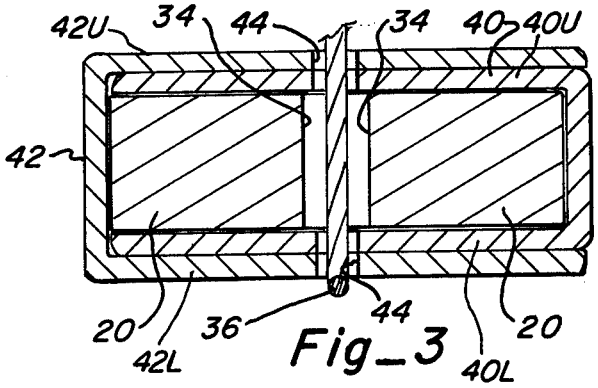
FIG. 3 is a section to a greatly enlarged scale taken along line 3—3 of FIG. 4.
Figure 4:
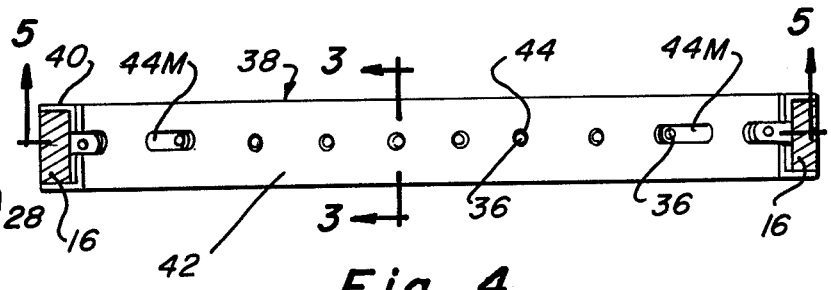
FIG. 4 is a section to a scale smaller than FIG. 3 but larger than FIG. 1 taken along line 4—4 of the latter figure.

Next, with specific reference to FIGS. 2, 3 and 4 it will be seen that both of the recessed surfaces 22 are provided with a series of spaced string-receiving notches 34 arranged in opposed, but not necessarily aligned, relation across from one another. The width of these notches is such that when the overlapped arcuate portions 20 are shifted to and fro relative to one another by tension adjustment means 32 as indicated by the broken lines in FIG. 5, a sufficient portion of each opposed pair of notches remains in registry with one another to accommodate a string 36. Note, however, that the more nearly aligned these opposed notches become, the greater latitude the string has to shift from side to side thereof. Accordingly, a two-part sleeve indicated broadly by numeral 38 functions to keep the strings 36 in proper position while, at the same time, permitting relative movement of the overlapped portions inside thereof. This two-part sleeve is shown most clearly in FIGS. 2 and 3 to which detailed reference will next be made.

In the particular form illustrated, sleeve 38 includes an inner shell 40 which is received telescopically inside outer shell 42 as shown in FIG. 2. Both shells have a channel-shaped cross section and are curved about the same radius of curvature as the overlapped section of the frame which they cooperate to enclose. While these overlapped portions of the frame are left free to shift relative to one another by the sleeve, the sleeve itself is fastened in fixed position with respect to the throat by the strings 36 passing through the string-receiving apertures 44 therein which register with one another and with the overlapped portions of the opposed notch pairs when the sections of the sleeve are telescoped one inside the other and centered on section 20 of the head with respect to the handle. The lower flanges 40L and 42L of the sleeve sections 40 and 42, respectively, are foreshortened in comparison to the upper flanges 40U and 42U so as to fit within the throat 26 when the limbs 18 are fully closed. Since the strings pass from one aperture 44 to the next along the underside of outside sleeve section 42 between every other pair thereof, it functions to hold the sleeve tightly in place. Elongate apertures 44M have no patentable significance in that they are found in conventional racquet frames at those particular locations where both a horizontal and a vertical string emerge from the same hole. Once again, two important functions of sleeve 38 are to maintain the proper string spacing in the throat area and to house the overlapped sections of the frame as they slide to and fro past one another. An equally, if not more important, function of sleeve 38 acting in cooperation with the strings 36 which thread through the sections thereof and hold them in assembled telescopic relation, is to engage and prevent the overlapped sections of the frame from moving apart, especially under the stress of play. In other words, in the absence of sleeve 38 or some other connector effective to hold the overlapped sections closed against one another while, at the same time, allowing them to slide arcuately, the racquet would be essentially inoperative for its intended use because nothing would prevent them from spreading apart especially under the influence of an off-center hit applying a twisting moment to the head.

Figure 6:
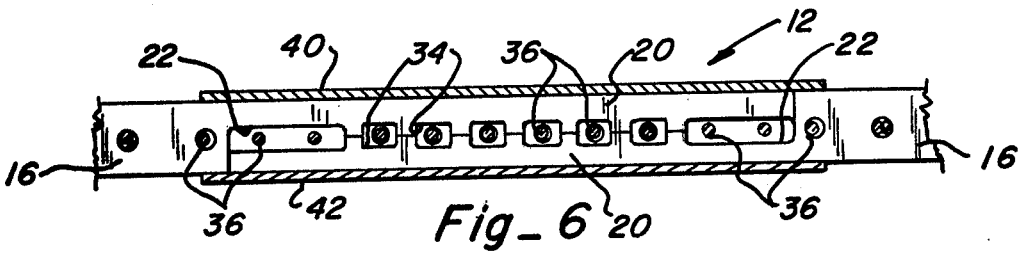
FIG. 6 is a fragmentary view from inside the head looking toward the handle similar to FIG. 4 and to the same scale but with covering portions broken away and shown in section to more clearly reveal the interior construction.
Figure 7:
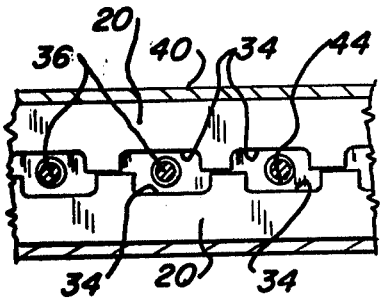
FIG. 7 is a further enlarged fragmentary view similar to FIG. 6 but showing the overlapped portions in the throat shifted relative to one another so as to vary the size of the head and the tension in the strings strung therein; and, FIG. 8 is a view like FIG. 7 and to the same scale but differing therefrom in the degree to which the overlapped portions are shifted relative to one another.
Figure 8:
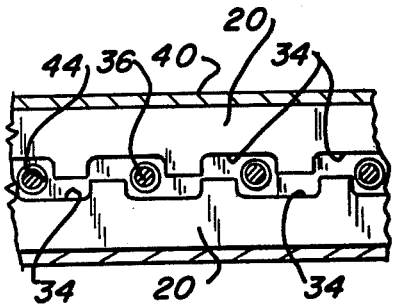

Finally, with reference to FIGS. 1, 2, 5 and 6–8, inclusive, the string tensioning means 32 will be described in detail. Opposed portions on the inside of the throat 26 are shown provided with permanently attached bosses 46 within which are non-rotatably mounted a pair of coaxial screws 48L and 48R each of which is threaded with threads of the opposite hands as shown. The adjacent ends 50 of these screws lie in spaced relation prior to stringing the frame so as to leave a gap 52 therebetween which, when closed, will cause the head to enlarge thus placing the strings under greater tension. These screws are operatively interconnected by an internally threaded sleeve or nut 54 which has the opposite ends thereof internally threaded with threads of the same hand as the screws that are threadedly received therein. As thus interconnected, screws 48 and nut 54 cooperate to define a turnbuckle operative upon actuation to either spread the limbs 18 of the frame apart and reduce the size of the hoop 16 or, alternatively, bring them closer together so as to enlarge the latter. The total adjustment needed is in the nature of less than an inch, therefore, any tilt of the screws out of coaxial relation as a result of the limbs moving relative to one another is so minimal as to be of no consequence. There are, of course, other well-known connectors which can be used in place of the turnbuckle arrangement shown; however, few if any of them are as compact, reliable, easy and fast to actuate or provide the fine positive adjustment that it does. To a degree in FIG. 4, but most clearly in FIGS. 6, 7 and 8, it can be seen how the opposed string-receiving notches 34 move sideways in opposite directions relative to one another while, at the same time, overlapping to the extent necessary to accommodate a string 36 located within the portions thus overlapped. FIG. 6 represents a more or less medial position while FIG. 8 shows the overlapped hoop sections approaching the extremes to which they may be adjusted short of pinching the strings. Of course, the position of FIG. 8 can be reached in either of two ways, i.e., by enlarging the hoop or making it smaller.

One final point that should, perhaps, be mentioned is that of using the turnbuckle subassembly and associated mounting structure as a means for varying the playing characteristics of the frame by stiffening of making the throat more flexible. In any racquet, this is a critical area and it should be apparent that by varying the size, weight and placement of these components, the designer can very the playing characteristics of the racquet to suit anyone from beginner to the most advanced player.

What is claimed is:

1. The stringable racquet frame which comprises: an elongate rod-like member having end portions connected by a medial portion, one of said end portions being bent and crossed over the other of said end portions to form a loop in said medial portion, said loop having arcuate sections adjoining said end portions, said arcuate sections being arranged in side-by-side overlapping relation, said end portions being bent at points adjacent said overlapped sections to define a pair of limbs extending radially outward from said overlapped sections in side-by-side spaced relation so as to cooperate with one another and with said overlapped sections to form an open throat at the junction between said limbs and loop, said limbs lying in coplanar relation to one another and to said loop, said loop having a plurality of spaced apertures therearound for the reception of strings, and said overlapped sections having the opposed surfaces thereof recessed to produce at least one gap therebetween sized, shaped and positioned to pass the strings therethrough while permitting relative arcuate movement between said surfaces in opposite directions so as to both expand and reduce the size of said loop; handgrip-forming means fastening the limbs together at a point spaced from the base of the loop, said handgrip-forming means and limbs cooperating with one another to define a handle; and string tension adjustment means operatively connected between the limbs across the throat, said tension adjustment means being effective upon actuation in a direction to spread said limbs apart to reduce the size of said loop and reduce the tension in said strings, and said tension adjustment means being effective upon actuation in a direction to close the gap between said limb to enlarge said loop and increase the string tension.

2. The stringable racquet frame as set forth in claim 1 in which: connecting means connect the overlapped sections of the loop together so as to permit relative arcuate movement therebetween without widening the gap.

3. The stringable racquet frame as set forth in claim 1 in which: the string tension adjustment means comprises cooperating screw and nut threadedly interengaged to define an assembly operative upon rotational movement of one of said screw and nut means relative to the other to either foreshorten or lengthen said assembly thereof.

4. The stringable racquet frame as set forth in claim 1 in which: string-retaining means bridges the gap between the opposed overlapped surfaces, said string retaining means defining an abutment around which each string can be threaded from within the loop, out through the gap into the throat and back again.

5. The stringable racquet frame as set forth in claim 1 in which: the gap between the opposed recessed surfaces comprises a series of alternating grooves and lands, said grooves in the opposed recessed surfaces being of a width and so arranged relative to one another as to have portions thereof lying in overlapped relation in all adjusted positions of the loop.

6. The stringable racquet frame as set forth in claim 2 in which: the connecting means comprises at least one sleeve with a longitudinal slot therein sized to receive the overlapped sections of the loop and a series of string-receiving openings spaced along the portion thereof underlying the gap.

7. The stringable racquet as set forth in claim 3 in which: said screw and nut means comprise a turnbuckle.

8. The stringable racquet frame as set forth in claim 3 in which: the screw means comprise a pair of screws of opposite hand non-rotatably attached to the limbs in spaced apart coaxial relation and said nut means contains internally threaded sockets positioned and adapted to receive said screws and widen the space therebetween upon rotation in one direction while narrowing said gap upon rotation in the opposie direction.

9. The stringable racquet frame as set forth in claim 4 in which: the string-retaining means comprises at least one arcuately shaped channel member having spaced flanges interconnected by a web, said channel being sized and shaped to receive the overlapped section and bridge the gap between the opposed surfaces thereof, and said flanges having a series of spaced string-receiving openings therein registering with said gap.

10. The stringable racquet frame as set forth in claim 5 in which the minimum width of the overlapped portion of the grooves is at least as wide as the thickness of a string of the type used to string the frame.

11. The stringable racquet frame as set forth in claim 6 in which: the sleeve comprises a pair of arcuate channel-shaped members one of which is telescoped inside the other, said members in telescoped relation having overlapped surfaces on the underside of the overlapped sections of the loop bridging the gap between the opposed surfaces thereof, and said overlapped surfaces each having a series of spaced string-receiving openings therein positioned to register with one another upon limited relative arcuate movement therebetween.

12. The stringable racquet frame as set forth in claim 9 in which: the string-retaining means includes a second arcuately shaped channel member having a web interconnecting spaced flanges, said flanges being spaced to receive the flanges of the first of said channel-shaped members therebetween in telescoped relation, and said flanges of said second channel-shaped member each having a series of spaced string-receiving apertures therein registering with the gap between the opposed surfaces of the loop while being placeable in registry with the apertures in the flanges of said first mentioned channel-shaped member upon limited relative arcuate movement therebetween.

* * * * *